US010301765B2

(12) United States Patent
Lee et al.

(10) Patent No.: US 10,301,765 B2
(45) Date of Patent: May 28, 2019

(54) DRYER AND CONTROL METHOD THEREOF

(71) Applicant: LG ELECTRONICS INC., Seoul (KR)

(72) Inventors: Sunki Lee, Seoul (KR); Byeongjo Ryoo, Seoul (KR); Jongseok Kim, Seoul (KR); Yongju Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 564 days.

(21) Appl. No.: 14/962,699

(22) Filed: Dec. 8, 2015

(65) Prior Publication Data

US 2016/0160431 A1 Jun. 9, 2016

(30) Foreign Application Priority Data

Dec. 9, 2014 (KR) ..... 10-2014-0176066
Dec. 15, 2014 (KR) ..... 10-2014-0180561

(51) Int. Cl.
*D06F 58/28* (2006.01)
*D06F 58/20* (2006.01)

(52) U.S. Cl.
CPC ..... *D06F 58/28* (2013.01); *D06F 58/206* (2013.01); *D06F 2058/2819* (2013.01); *D06F 2058/2829* (2013.01); *D06F 2058/2832* (2013.01); *D06F 2058/2838* (2013.01); *D06F 2058/2861* (2013.01); *D06F 2058/2877* (2013.01)

(58) Field of Classification Search
CPC ..... D06F 58/28; D06F 58/206; D06F 2058/2877; D06F 2058/2838; D06F 2058/2832; D06F 2058/2819; D06F 2058/2829; D06F 2058/2861
See application file for complete search history.

(56) References Cited

U.S. PATENT DOCUMENTS

2012/0005918 A1 1/2012 Kim et al.

FOREIGN PATENT DOCUMENTS

CN 101994246 3/2011
CN 102433722 5/2012
(Continued)

OTHER PUBLICATIONS

Extended European Search Report issued in European Application No. 15198639.5 dated May 19, 2016, 10 pages.
(Continued)

*Primary Examiner* — Jessica Yuen
(74) *Attorney, Agent, or Firm* — Fish & Richardson P.C.

(57) ABSTRACT

A method of controlling a dryer includes rotating a drum within the dryer in a first direction, detecting at least one of temperature or relative humidity of air discharged from the drum while the drum is rotating in the first direction, and sensing occurrence of entanglement inside the drum by comparing a variation rate of at least one of the detected temperature or the detected relative humidity with a corresponding reference value. The method also includes, based on sensing that the entanglement has occurred, reversing a rotation direction of the drum by rotating the drum in a second direction that is opposite the first direction, and further, based on reversing the rotation direction of the drum upon sensing that the entanglement has occurred, maintaining the second direction of rotation of the drum for a preset time.

8 Claims, 20 Drawing Sheets

(56) References Cited

FOREIGN PATENT DOCUMENTS

| | | | | | |
|---|---|---|---|---|---|
| CN | 103210134 | | | 7/2013 | |
| CN | 103732823 | | | 4/2014 | |
| DE | 102009045470 | | | 5/2010 | |
| EP | 2113603 | | | 11/2009 | |
| EP | 2436833 | | | 4/2012 | |
| EP | 2540907 | A1 | * | 1/2013 | ..... D06F 58/28 |
| EP | 2666902 | | | 11/2013 | |
| JP | 57056720 | A | * | 4/1982 | ..... G01G 17/04 |
| JP | H05-317590 | | | 12/1993 | |
| JP | H 07-269170 | A | | 10/1995 | |
| JP | 2004-344337 | | | 12/2004 | |
| JP | 2011-152175 | A | | 8/2011 | |
| KR | 10-1999-0041416 | A | | 6/1999 | |
| KR | 1019990041416 | | | 6/1999 | |
| KR | 10-0317295 | A | | 12/2001 | |
| KR | 10-2006-0046995 | A | | 5/2006 | |
| KR | 10-0823328 | A | | 4/2008 | |
| KR | 10-1143685 | A | | 5/2012 | |
| KR | 10-2012-0088034 | A | | 8/2012 | |

OTHER PUBLICATIONS

Korean Office Action dated Jul. 9, 2015 for Korean Application No. 10-2014-0176066, 5 pages.
Korean Office Action dated Jul. 16, 2015 for Korean Application No. 10-2014-0180561, 6 pages.
Chinese Office Action in Chinese Application No. 201510895229.0, dated May 27, 2017, 15 pages. (with English translation).

* cited by examiner

DRYER AND CONTROL METHOD THEREOF

CROSS-REFERENCE TO RELATED APPLICATION

Pursuant to 35 U.S.C. § 119(a), this application claims the benefit of earlier filing date and right of priority Korean Application No. 10-2014-0176066, filed on Dec. 9, 2014, and Korean Application No. 10-2014-0180561, filed on Dec. 15, 2014, the contents of which are incorporated by reference herein in their entirety.

FIELD

The present disclosure relates to a dryer and a control method thereof, in particular a dryer having a drum whose rotational direction is changeable.

BACKGROUND

In general, a clothes dryer is an apparatus for drying laundry by blowing hot air generated by a heater into a drum to evaporate moisture contained in the laundry.

In a drum rotation type dryer in which wet objects are dried by rotating a drum having the wet objects positioned therein, a direction in which the drum rotates is reversed at predetermined intervals. Thus the wet objects inside the drum may be dried by falling down due to the rotation of the drum and coming in contact with heated air flowing into the drum.

When the wet objects inside the drum get tangled with one another, the wet objects may form a lump, which may have a reduced surface area that comes in contact with the heated air. Accordingly, the heated air may not come in sufficient contact with the wet objects. In this case, the drying may not proceed effectively. Moreover, the entanglement may become evident only after a considerable time passes, thus potentially causing a decrease in energy efficiency of the drying and an increase in a time of the drying.

SUMMARY

Therefore, an aspect of this disclosure is to provide a dryer that may determine whether the entanglement has occurred in which wet objects are tangled with one another and a control method thereof.

Another aspect of the detailed description is to provide a dryer that may clear such entanglement, which can cause a decrease in drying energy efficiency and an increase in a drying time, and a control method thereof.

According to one aspect, a method of controlling a dryer includes rotating a drum within the dryer in a first direction, detecting at least one of temperature or relative humidity of air discharged from the drum while the drum is rotating in the first direction, and sensing occurrence of entanglement inside the drum by comparing a variation rate of at least one of the detected temperature or the detected relative humidity with a corresponding reference value. The method also includes, based on sensing that the entanglement has occurred, reversing a rotation direction of the drum by rotating the drum in a second direction that is opposite the first direction, and further, based on reversing the rotation direction of the drum upon sensing that the entanglement has occurred, maintaining the second direction of rotation of the drum for a preset time.

Implementations according to this aspect may include one or more of the following features. For example, maintaining the second direction of rotation of the drum may include, based on passing of the preset time, detecting at least one of temperature or relative humidity of air discharged from the drum while the drum is rotating in the second direction, and comparing a variation rate of at least one of the detected temperature or relative humidity of the drum rotating in the second direction with the corresponding reference value. The detecting of at least one of the temperature and the relative humidity of the air may include measuring the relative humidity of the air, and the corresponding reference value may be between 1.3%/min and 1.7%/min. The detecting of at least one of the temperature and the relative humidity of the air may include measuring the temperature of the air, and the corresponding reference value may be between 0.4 k/min and 0.6 k/min.

In some implementations, the method may further include detecting weight of condensed water per unit time that is discharged from the drum while the drum is rotating in the first direction, where the sensing of the occurrence of the entanglement may include comparing a variation rate of the detected weight of the condensed water per unit time with a reference value to thereby determine the occurrence of the entanglement inside the drum. The method may also include, based on sensing of the occurrence of the entanglement inside the drum, detecting the other of the temperature or the relative humidity of the air discharged from the drum, and comparing a variation rate of the detected other of the temperature or the relative humidity with a reference value to thereby additionally determine the occurrence of the entanglement inside the drum. In some cases, the sensing of the occurrence of the entanglement inside the drum may include sensing the occurrence of the entanglement inside the drum based on the variation rate of the detected weight of the condensed water per unit time, and additionally sensing the occurrence of the entanglement inside the drum based on the variation rate of the detected at least one of the temperature and the relative humidity after the occurrence of the entanglement inside the drum is sensed based on the variation rate of the weight of the condensed water. The reference value may be set according to a variation rate of at least one of the temperature of the air, the relative humidity of the air, or the weight of the condensed water per unit time up to the current time.

In some cases, the method may further include maintaining the rotational direction of the drum in the first direction for a first preset time before the sensing of the occurrence of the entanglement inside the drum, and maintaining the rotational direction of the drum in the second direction for a second preset time after the sensing of the occurrence of the entanglement inside the drum, where the second preset time may be longer than the first preset time.

According to another aspect, a dryer, which includes a drum positioned therein, a motor configured to rotate the drum, and a sensor configured to detect at least one of temperature or relative humidity of air discharged from the drum, includes a controller that is configured to control the dryer by rotating the drum in a first direction, detecting at least one of temperature or relative humidity of air discharged from the drum rotating in the first direction, sensing occurrence of entanglement inside the drum by comparing a variation rate of the detected at least one of the temperature or the relative humidity with a reference value, based on sensing that the entanglement has occurred, rotating the drum in a second direction that is opposite the first direction, and maintaining the second direction of rotation of the drum for a preset time.

Implementations according to this aspect may include one or more of the following features. For example, the dryer may further include a condenser configured to condense moisture in the air discharged from the drum and passing through the condenser, and a condensed water sensor configured to detect weight of the condensed water per unit time condensed by the condenser. The controller may be further configured to sense the occurrence of the entanglement inside the drum by comparing a variation rate of the weight of the condensed water per unit time detected by the condensed water sensor with a reference value. In some cases, the controller may be further configured to maintain the rotational direction of the drum in the first direction during a first preset time before the sensing of the occurrence of the entanglement inside the drum, and maintain the rotational direction of the drum in the second direction during a second preset time after the sensing of the occurrence of the entanglement inside the drum, where the second preset time may be longer than the first time. Additionally, the controller may be configured to set the reference value based on information regarding a variation rate of at least one of the temperature of the air, the relative humidity of the air, or the weight of the condensed water per unit time up to the current time.

DETAILED DESCRIPTION

Figure 1:
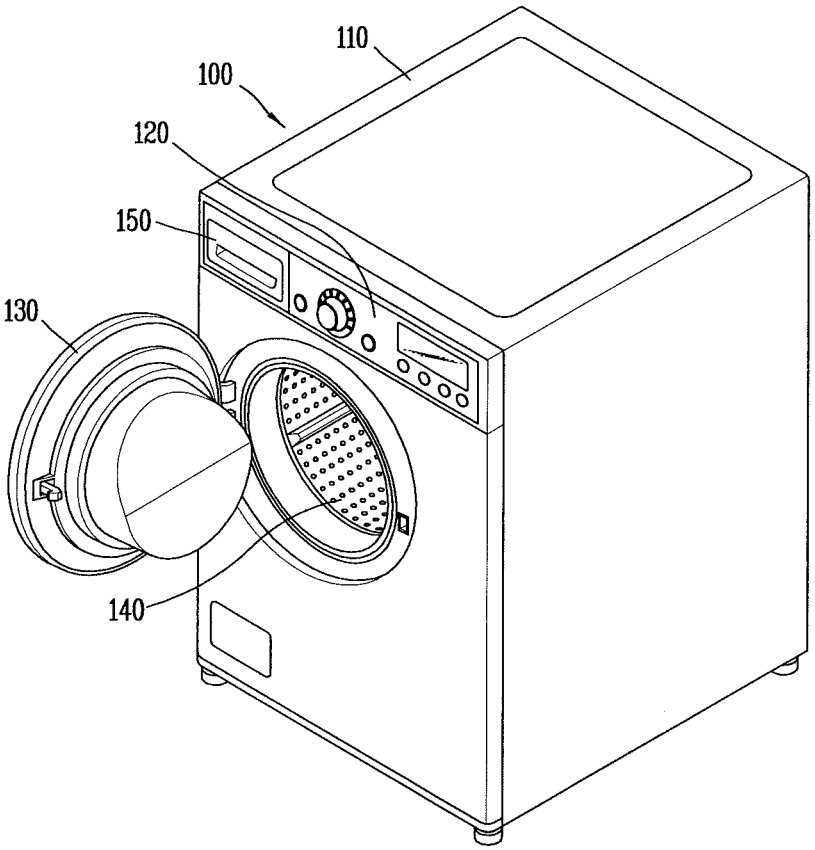
FIG. 1 is a perspective view showing an exterior of an example dryer according to one implementation.

Referring to FIG. 1, a dryer 100 includes a main body 110 forming an exterior and a drum 10 rotatably installed in the main body 110 and having a plurality of protruding lifters in an inner surface. The main body has a front surface in which an entrance for inserting clothes, namely wet objects, into the main body is formed.

The entrance 140 may be opened or closed by a door 130. A control panel 120 in which various operating buttons for operating the dryer and a display device may be arranged is positioned above the entrance 140. A drawer 150 may be provided at one side of the control panel 120. Liquid to be sprayed into the drum may be stored in the drawer 150.

Figure 2:
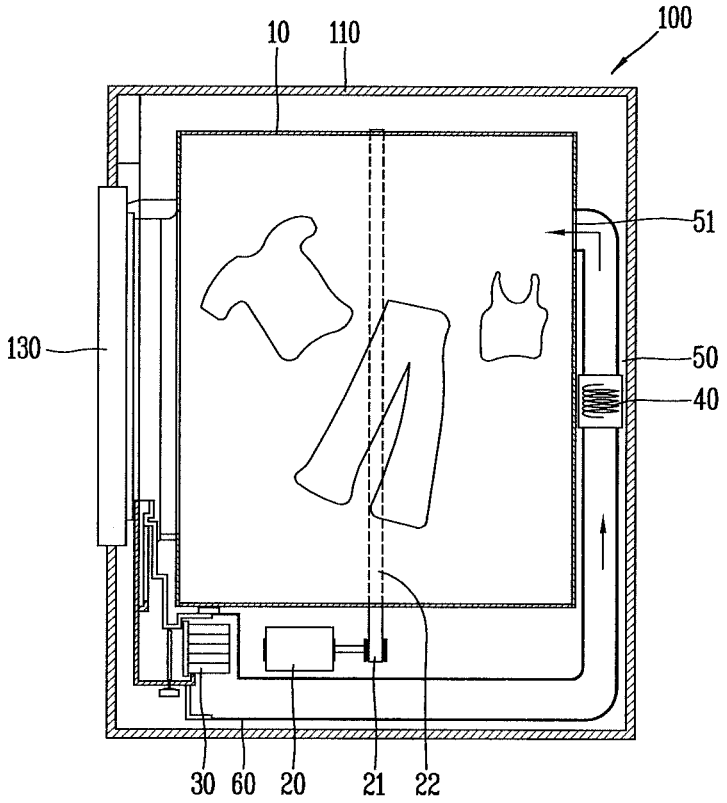
FIG. 2 is a partial cross-sectional view showing an interior of the dryer of FIG. 1.
Figure 3:
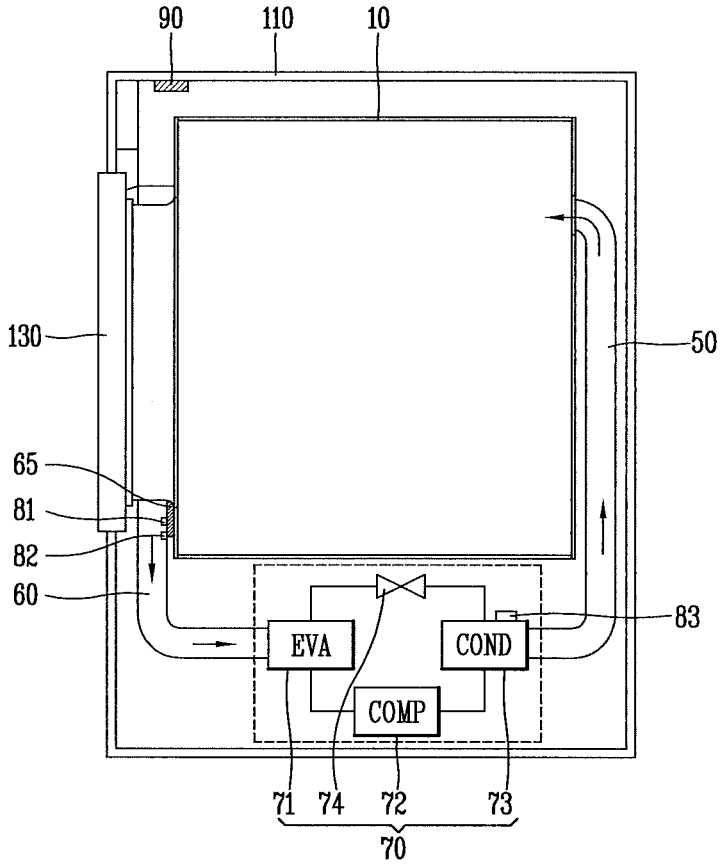
FIG. 3 is a schematic diagram showing an example heat pump system included in the dryer of FIG. 2.

FIGS. 2 and 3 shown an interior of the dryer 100. Referring to FIG. 2, a drum 10 that is configured to dry wet objects may be rotatably installed inside the main body 110. The drum 10 may be supported by supporters at front and rear sides such that the drum 10 can rotate.

The drum 10 may be connected with a driving motor 20 provided in a lower portion of the dryer through a power transfer belt 22 and configured to receive rotational force. The driving motor 20 may include a pulley 21 at one side. The power transfer belt 22 may be connected to the pulley 21 in order to drive the drum 10.

An intake duct 50 may be installed at the rear of the drum 10. A heater 40 for heating inlet air may be installed in the inlet duct. The heater 40 may use high electrical resistance heat in order to increase efficiency of a space occupied by the dryer. The intake duct may be connected to the rear of the drum 10 and may include an outlet 51 for discharging heated air to the drum 10.

A filter 65 for filtering out foreign material such as lint included in the air discharged from the drum 10 and an exhaust duct 60 for discharging air from which foreign material has been filtered out from the drum may be installed at the front and the bottom of the drum 10. The intake duct and the exhaust duct are used for intake and discharge with respect to the drum. While FIG. 2 shows an example of a circulation type dryer, the present disclosure is not limited thereto and may be applied to an exhaust type dryer.

In an example of a circulation type dryer such as that shown in FIG. 2, the intake duct 50 and the discharge duct 60 are connected in one body to form one circulation flow path 55. However, in an example of a discharge type dryer, the intake duct and the discharge duct are not connected with each other.

A blower fan 30 for absorbing air in the drum 10 and forcibly blowing the air may be installed in the discharge duct 60. For the circulation type dryer of FIG. 2, for example, the discharge duct serves to guide air forcibly blown by the blower fan 30 to the drum 10 through the intake duct 50. For the discharge type dryer, however, the discharge duct serves to guide air forcibly blown by the blower fan 30 to the outside.

In an example shown in FIG. 3, a heat pump system 70 may be provided to absorb waste heat from the air discharged from the drum and supply the absorbed heat to the air flowing into the drum. The example dryer of FIG. 3 may be the circulation type dryer or the discharge type dryer.

The heat pump system 70 forms a thermodynamic cycle by including a first heat exchanger 71 for absorbing the waste heat from the air discharged from the drum, a compressor 72, a second heat exchanger 73 for heating air discharged into the drum, and an expansion valve 74. Accordingly, the first heat exchanger, the compressor, the second heat exchanger, and the expansion valve may be sequentially connected through pipes.

Referring again to FIG. 3, the dryer may further include a sensor and a controller 90.

The sensor may be disposed in the discharge duct 60 and configured to detect at least one of temperature and relative humidity of air discharged from the drum 10. A humidity sensor 81 may detect relative humidity of the air discharged from the drum 10, and a temperature sensor 82 may detect temperature of the air discharged from the drum 10. In addition, the sensor may be provided on the rear surface of a lint removal filter 65 in order to measure accurate relative humidity and temperature and measure relative humidity and temperature of less contaminated air. The sensor may alternatively be positioned at other locations.

The sensor may begin to detect the relative humidity or temperature from a start time of the drying. Information regarding the relative humidity or temperature of air detected from the sensor may be delivered to the controller 90 to be described below and may be used to control a change of a rotational direction of the drum 10 to be described below and an end of the drying.

Referring to FIG. 3, the controller may be disposed adjacent to the rear surface of the control panel 120. However, the location of the controller 90 is not limited thereto, and the controller 90 may be freely disposed according to the need in the structure of the dryer 100.

At the start time of the drying, the controller may allow the sensor to receive detection information regarding at least one of the temperature and the relative humidity of the air discharged from the drum 10 that rotates in one direction.

The controller may compare a variation rate of at least one of the detected temperature and relative humidity with a reference value to sense the occurrence of the entanglement inside the drum 10. When the entanglement in which wet objects are lumped together occurs in the drum 10, the controller can control the rotational direction of the motor to be reversed, and thus the rotational direction of the drum 10 is allowed to rotate in a reverse direction. A method of sensing the occurrence of the entanglement will be described below in detail.

After the rotational direction of the drum 10 is changed, the entanglement phenomenon may be solved. However, the relative humidity or temperature of the air discharged from the drum 10 may experience a large fluctuation. Accordingly, there may be a need that the rotational direction of the drum 10 should not be changed again during a certain length of time such that the controller does not sense that the entanglement has occurred in the drum 10 due to such a fluctuation. Accordingly, the controller may include maintaining the rotational direction of the drum 10 during the certain length of time, which for example may be preset.

The above-described heat pump system 70 may include a condenser 73 for condensing moisture included in the air discharged from the drum 10. The heat pump system 70 may further include a condensed water sensor 83 disposed in the condenser and configured to detect the weight of the condensed water per unit time, which is condensed in the condenser.

In addition, the controller may further sense the occurrence of the entanglement inside the drum 10 by comparing a variation rate per unit time of the weight of the condensed water which is detected by the condensed water sensor with a reference value for the condensed water. The comparison will be described in detail below.

Figure 4A:
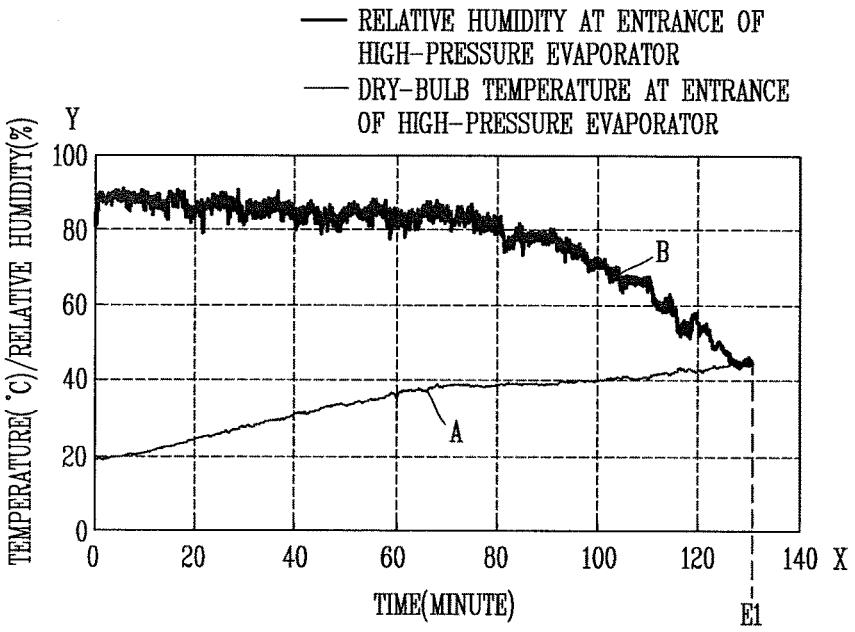
FIGS. 4A and 4B are graphs showing example relationships between relative humidity and temperature with respect to time in, respectively, a normal state and an entanglement state in which wet objects are tangled with one another.
Figure 4B:
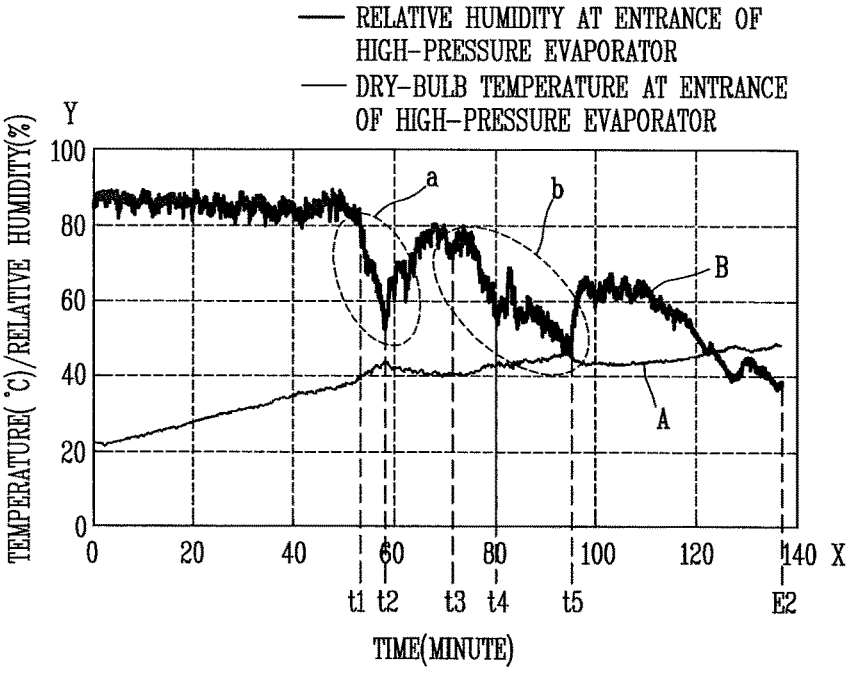

FIGS. 4A and 4B show an example relationship between temperature (A) and relative humidity (B) with respect to time in a normal state and an entanglement state in which wet objects are tangled with one another.

FIG. 4A is an example graph showing temperature (A) and relative humidity (B) with respect to time of the air discharged from the drum until a drying process is completed in a normal state in which an entanglement does not occur while the dryer dries an wet object in the drum. FIG. 4B is an example graph showing temperature (A) and relative humidity (B) when the entanglement has occurred while the wet object is dried.

Referring to FIG. 4A, a line drawn at the bottom of the graph is temperature (A), and a line drawn at the top of the graph is relative humidity (B). In the graph of temperature (A) and the graph of relative humidity (B), raw data is represented, and its fluctuation is severely represented. Accordingly, temperature (A) and relative humidity (B) may be represented by performing replacement with average values during a certain time, and the average values may be called moving average values. The fluctuation of the graph may be reduced by representing the moving average values.

Referring again to FIG. 4A, a value of relative humidity B tends to be reduced over time. In detail, the graph is in the form of an almost straight line for about 20 minutes after the start of the drying, and the graph is inclined at a small angle from about 20 minutes to about 60 minutes after the start of the drying. After about 80 minutes, relative humidity B decreases with a greater slope. This is because the wet object is dried over time, and thus moisture contained in the wet object is reduced. Unlike the graph of relative humidity (B), the graph of temperature (A) tends to increase over time.

In addition, the drying is completed at a point E1 of about 130 minutes at which the graph ends.

Referring to FIG. 4B, it can be seen that largely two entanglements (a) and (b) have occurred. It can be seen that the first entanglement (a) has occurred at a time t1 and a disentanglement has begun at a time t2. It can be seen that the second entanglement (b) is started at an approximate time t3, mitigated for a moment at a time t4, maintained again, and again clearly present at a time t5. The total drying time ends at an approximate 140 minutes (E2). Thus, it takes longer time than in a normal state in which the entanglement has not occurred.

When the entanglement has occurred, the graph shows a section in which relative humidity (B) decrease significantly while temperature (A) increases significantly. This can be because, while hot dry air supplied with a quantity of heat from the heater 40 (see FIG. 2) disposed adjacent to the entrance for supplying air to the drum passes through the rotating drum, the quantity of heat cannot be effectively delivered to the wet object due to the occurrence of the entanglement, and thus a sensible heat load of the air is not relatively changed to a latent heat load.

Figure 5:
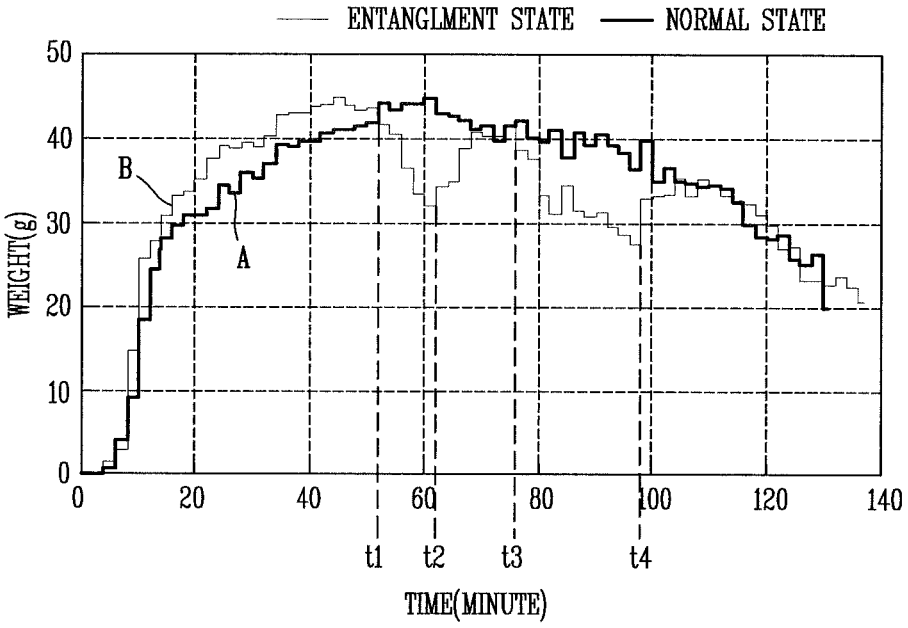
FIG. 5 is a graph showing an example relationship between the weight of condensed water with respect to time in both a normal state in which an entanglement has not occurred and an entanglement state in which the entanglement has occurred.

FIG. 5 is an example graph showing weight of condensation water with respect to time in a normal state in which an entanglement has not occurred and an entanglement state in which an entanglement has occurred.

Line A indicates the weight of the condensed water per unit time in the normal state in which the entanglement has not occurred, and line B indicates the weight of the condensed water per unit time in the state in which the entanglement has occurred.

In an overall flow of line A, the condensed water increases rapidly at an earlier state of the drying, and the condensed water decreases gradually at a later state of the drying. It can be seen from line B that the amount of generation of the condensed water per unit time decreases before and after 60 minutes t1 and t2 and before and after 90 minutes t3 and t4. As described above, the amount of generation of the condensed water discharged from the drum decreases as the relative humidity decreases in the drum, that is, the amount of evaporation from the wet object decreases.

Referring again to FIG. 5, it can be seen, as a sample experimental result, that in comparison of line A and line B, a case in which the entanglement has occurred is greater than a case in which the entanglement has not occurred by a factor of 4% in terms of time and by a factor of 7% in terms of energy consumption.

Figure 6:
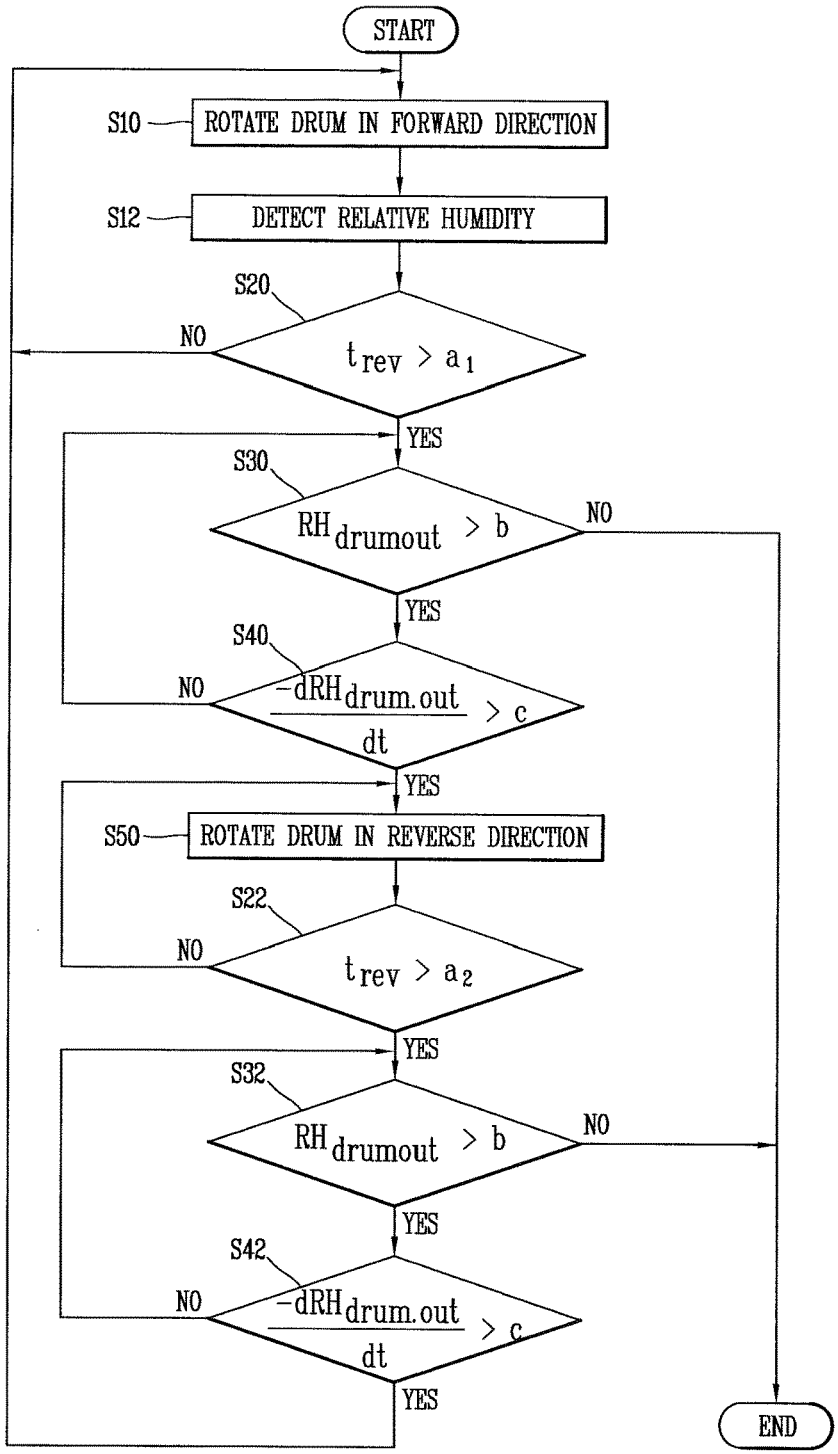
FIG. 6 is a flowchart showing an example control method of a rotational direction of a drum using a variation rate per unit time of relative humidity of air discharged from a drum.

FIG. 6 is a flowchart showing an example control method of a rotational direction of a drum using a variation rate per unit time of relative humidity of air discharged from a drum.

Referring to FIG. 6, the control method includes rotating the drum in any one direction (hereinafter referred to as a forward direction) when the dry starts (S10). The control method include detecting humidity of air discharged from the drum by a humidity sensor 81 of a sensor when the dry starts (S12). However, in the above step, temperature of the air discharged from the drum may also be detected.

The control method may further include maintaining the rotational direction of the drum for a first time a1 when the drying starts and the drum rotates (S20). This is for preventing the drum from rotating in a reverse direction due to an instantaneous change in relative humidity and temperature in a short time after the drum rotates. Here, the first time a1 may be selected among several minutes to several tens of minutes as appropriate by those skilled in the art.

Subsequently, the control method may include comparing the detected relative humidity and a dry humidity value (b) (S30). When the detected relative humidity RH_drumout is lower than the dry humidity value (b), it is determined that the web object in the drum has been sufficiently dried, and thus a drying process of the dryer ends.

When the drying process does not end, a comparison is performed between the detected variation in the relative humidity with respect to time and an entanglement humidity variation value (c). The control method may include determining whether the entanglement has occurred in the drum through the comparison (S40).

When the entanglement has occurred in the drum as described above, the detected relative humidity of the air may be reduced. When the variation in the relative humidity with respect to time is greater than the entanglement humidity variation value (c), it may be determined that the entanglement has occurred. In this case, when the entanglement has occurred, the relative humidity is reduced, and thus the variation in the relative humidity with respect to time has a negative value. Accordingly, the entanglement humidity variation value (c) is set to be a positive number, and an absolute value of the variation in the relative humidity with respect to time is taken. Thus, it is possible to compare the positive numbers. However, unlike FIG. 6, the entanglement humidity variation value (c) is set to be a negative number, and it may be determined whether the variation in the relative humidity with respect to time is less than the entanglement humidity variation value (c).

As described above, since the value obtained by detecting the relative humidity is raw data, and its fluctuation may be great, the variation in relative humidity with respect to time may be calculated on the basis of an average value (a moving average value) during a certain time.

When it is determined whether the entanglement has occurred, the control method may include rotating the drum in the reverse direction such that the entanglement is clear (S50). The entanglement may be rapidly clear by rotating the drum in a direction opposite to an original rotational direction.

After the rotational direction of the drum is changed, the control method may include maintaining the rotational direction of the drum during a certain time (hereinafter referred to as a second time a2) such that the rotational direction of the drum is not changed for the second time a2 (S22). Here, the first time a1 and the second time a2 may have independent times. Since the change in the rotational direction is due to the entanglement, a longer time than the first time a1 is required.

In addition, when two or more entanglements have occurred in the drum, the first time a1 immediately after the drying is started and the first time a1 when the rotational direction of the drum is changed to a reverse direction and changed again to a forward direction. This is because a duration of the rotational direction of the drum may need to be longer when the rotation is changed due to the entanglement.

Here, the maintaining of the rotational direction of the drum (S22) may include comparing a degree RH_drumout of change in the detected relative humidity with the entanglement humidity variation value (c) when the certain time a2 passes after the rotational direction of the drum is changed. In addition, the step S22 may include comparing the degree of change in temperature detected over time with a temperature reference value (d). This will be described below in detail.

In this case, the entanglement humidity variation value (c) may be, for example, from 1.3%/min to 1.7%/min. That is, when any one value is selected between 1.3% and 1.7% as a variation in the relative humidity per minute, and the selected value is greater than a variation in the relative humidity with respect to time, it may be determined that the entanglement has occurred.

In the determining of whether the entanglement has occurred (S40, S42), when it is not determined that the entanglement has occurred, the processing proceeds again to the determining of whether a value of the relative humidity is equal to or less than the dry humidity value (b) (S30 and S32) in order to determine whether the dry is sufficiently performed.

Figure 7:
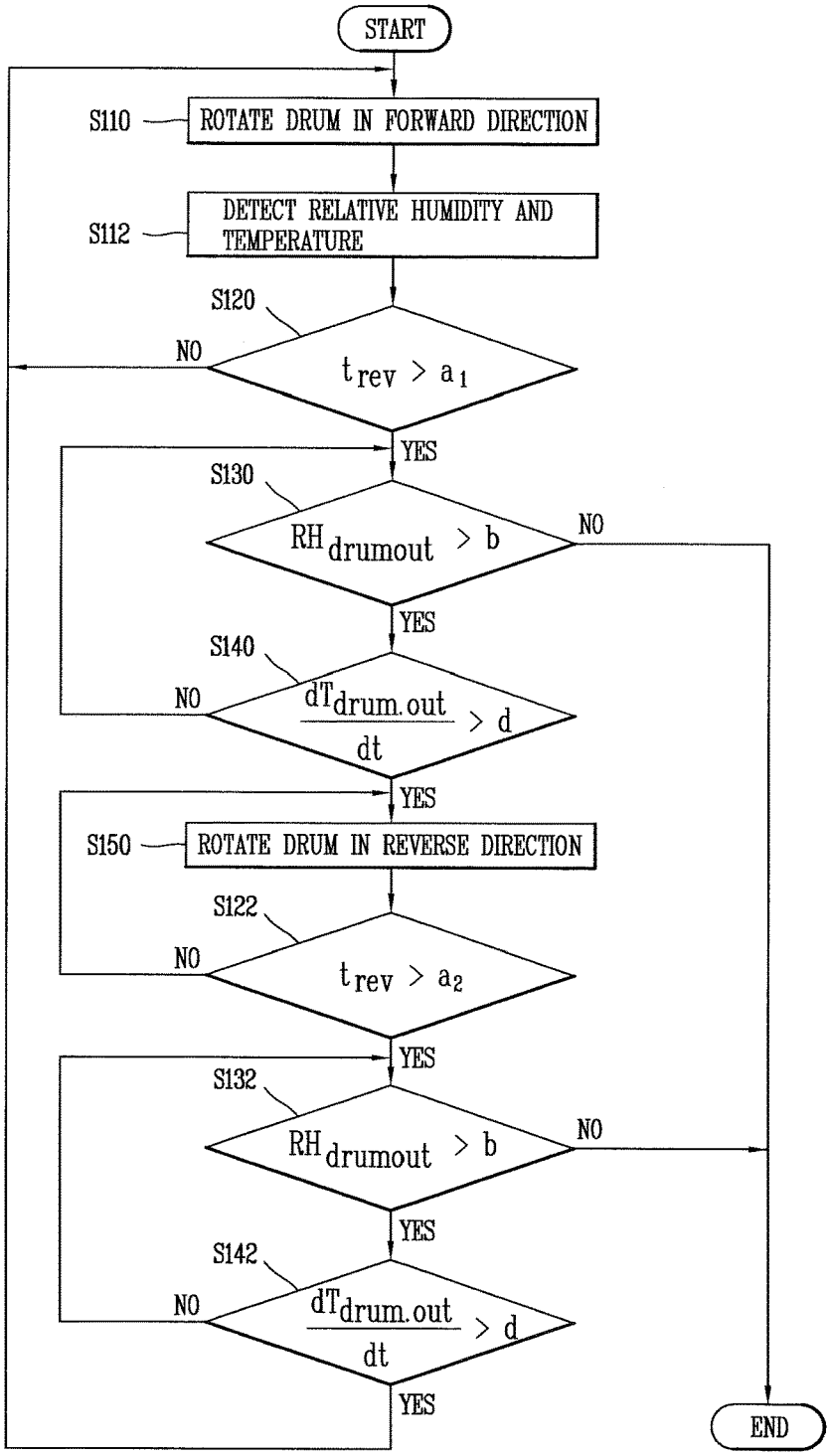
FIG. 7 is a flowchart showing an example control method of a rotational direction of a drum using relative humidity of air discharged from the drum and a variation rate of temperature per unit time.

FIG. 7 is a flowchart showing an example control method of a rotational direction of a drum using relative humidity of air discharged from the drum and a variation rate of temperature per unit time. The flowchart of FIG. 7 has a similar flow to the flowchart of FIG. 6, and thus differences therebetween will be mainly described.

Referring to FIG. 7, the control method may detecting temperature of air discharged from the drum in addition to the relative humidity thereof (S112). The control method may include maintaining a rotational direction of the drum (S120), determining whether the wet object has been sufficiently dried (S130), and using the detected temperature to determine whether the entanglement has occurred in the drum (S140).

The determining of whether the entanglement has occurred in the drum (s140) may include determining that the entanglement has occurred in the drum when a variation in temperature of the air discharged from the drum with respect to time is greater than the entanglement temperature variation value (d).

In addition, the entanglement temperature variation value (d) may be between, for example, 0.4 k/min to 0.6 k/min. However, the above-described value is not limited thereto and thus a value other than the value may be selected by those skilled in the art as necessary or may be selected in consideration of the capacity of the dryer.

When it is determined that the entanglement has occurred, the rotational direction of the drum can be changed to the reverse direction. The control method may include maintaining the rotational direction of the drum (S122), ending the drying process when the wet object has been sufficiently dried (S132), and determining whether the entanglement has occurred again (S142).

Figure 8:
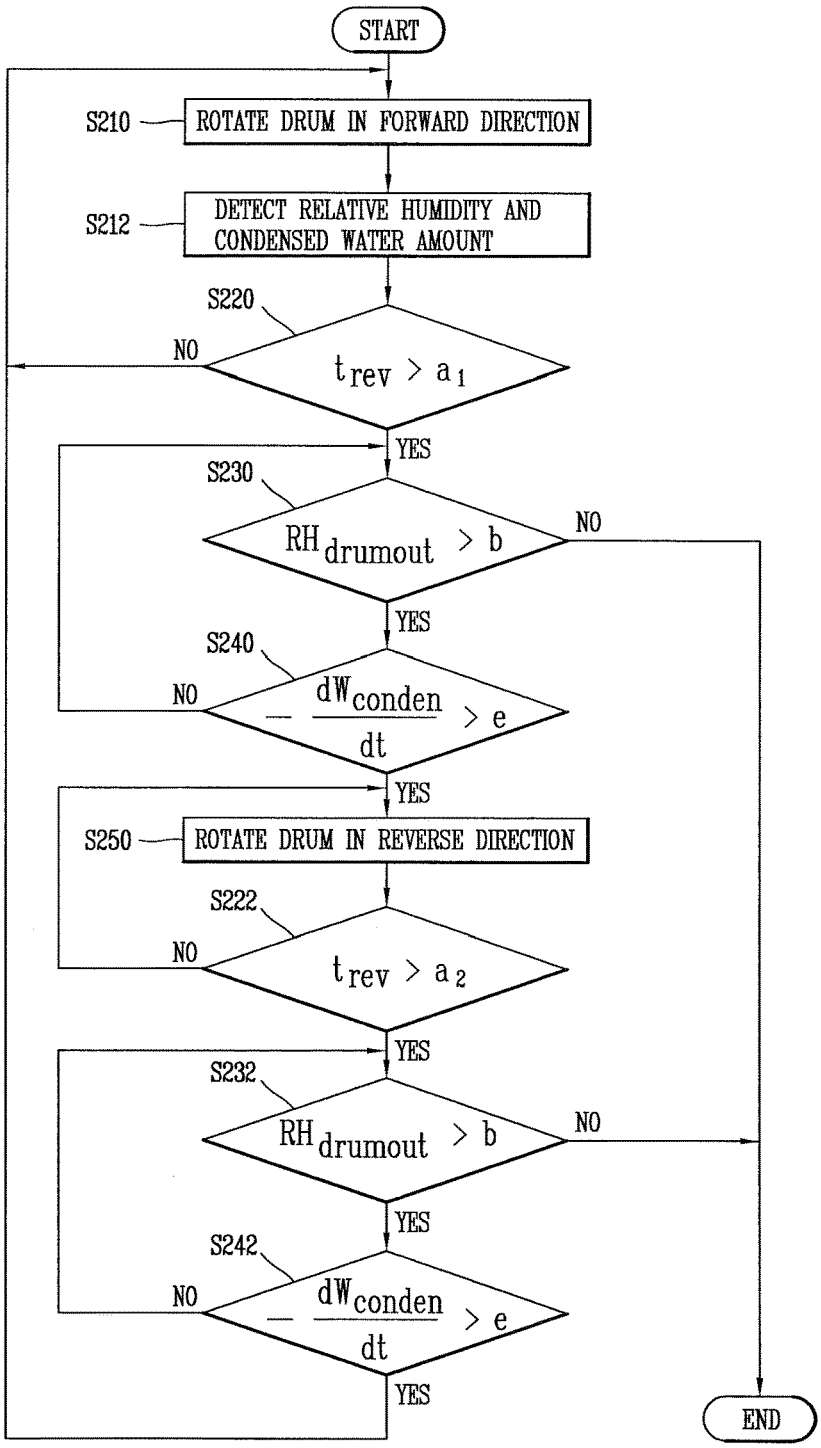
FIG. 8 is a flowchart showing an example control method of a rotational direction of a drum using relative humidity of air discharged from the drum and weight of condensed water per unit time.

FIG. 8 is a flowchart showing an example control method of a rotational direction of a drum using relative humidity of air discharged from the drum and weight of condensed water per unit time.

Referring to FIG. 8, the control method may include rotating the drum in a forward direction (one direction) when the dry starts (S210). The control method may include detecting the relative humidity of the air discharged from the drum and the amount of condensed water per unit time, which is condensed by a condenser (S212).

The control method may include maintaining the rotational direction during a certain time (S220), determining whether the drying has been sufficiently performed (S230), and determining whether the entanglement has occurred in the drum by comparing a variation rate of the weight of the detected condensed water per unit time with the entanglement condensed water variation value (e) (S240).

As described above with reference to FIG. 5, when the entanglement has occurred, the detected condensed water per unit time may be reduced rapidly. Accordingly, it may be determined whether the entanglement has occurred by comparing the variation rate of the condensed water per unit time with the entanglement condensed water variation value (e). Since the condensed water per unit time decreases, the variation rate of the condensed water per unit time has a negative value. Accordingly, an absolute value of the variation rate of the condensed water per unit time is taken to make a positive value, and then the positive value may be compared with the entanglement condensed water variation value (e). This is due to the same reason as the above-described variation rate of the relative humidity with respect to time and may be determined in the same way as the variation rate of the relative humidity with respect to time.

The control method may include rotating the drum in the reverse direction such that the entanglement is clear when the entanglement has occurred (S250).

The control method may further include maintaining the rotational direction of the drum such that, after the rotational direction of the drum is changed, the rotational direction is not changed again (S222). Subsequently, the control method includes determining whether the dry has sufficiently been performed (S232) and determining whether the entanglement has occurred using the variation in condensed water amount with respect to time (S242).

Figure 9:
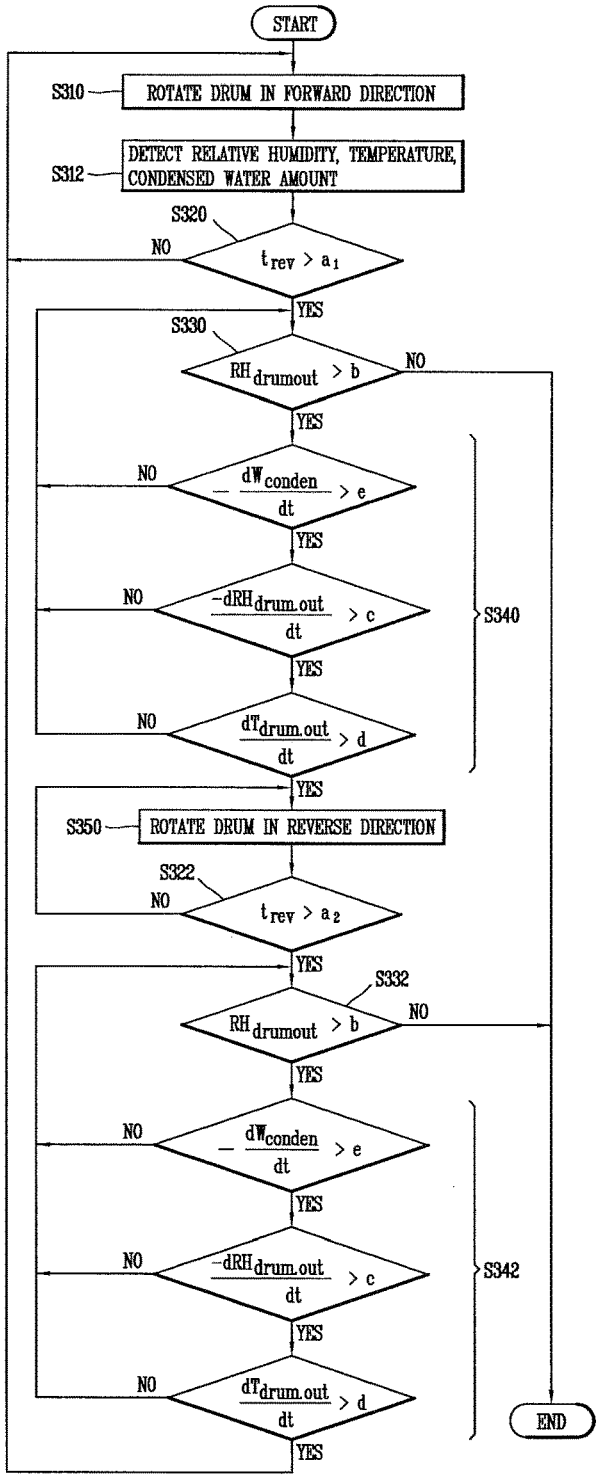
FIG. 9 is a flowchart showing an example control method of a rotational direction of a drum using weight of condensed water per unit time, relative humidity of air discharged from the drum, and a variation rate of temperature with respect to time.
Figure 10:
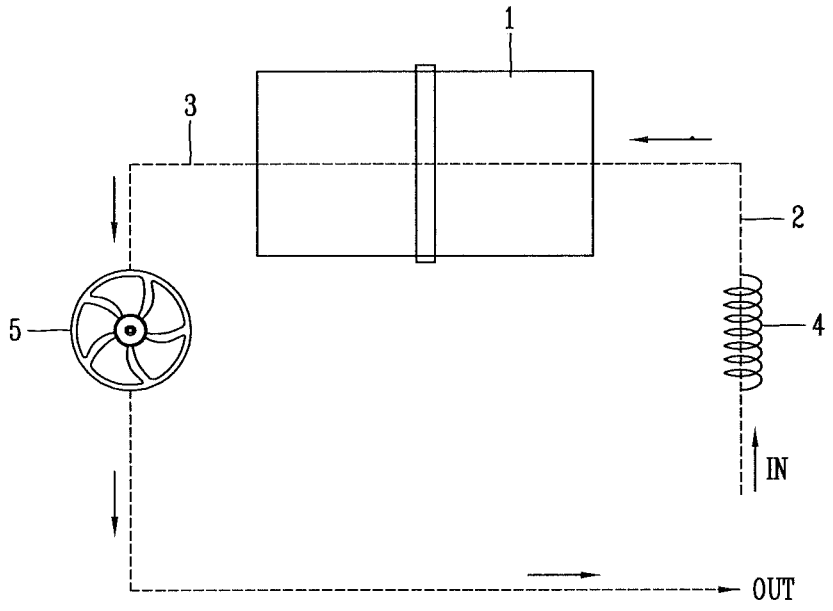
FIG. 10 is a schematic diagram showing an example of a conventional exhaust type clothes dryer.

FIG. 9 is a flowchart showing an example control method of a rotational direction of a drum using weight of condensed water per unit time, relative humidity of air discharged from the drum, and a variation rate of temperature with respect to time.

Referring to FIG. 9, the control method may include rotating the drum in a forward direction (one direction) when the dry starts (S310) and detecting relative humidity, temperature, and condensed water (S312).

Subsequently, the control method may include maintaining the rotational direction of the drum during a certain time (S320) and determining whether the dry has sufficiently been performed (S330).

The control method may include determining whether the entanglement has occurred by comparing the variation in condensed water per unit time with the entanglement condensed water variation value (e). In this case, the control method may further include determining whether the entanglement has occurred by comparing the variation in relative humidity with respect to time and the variation in temperature with respect time with the entanglement humidity value (c) and the entanglement temperature variation value (d), respectively (S340). This is because there is a possibility of occurrence of an error when only one kind of factor is used to determine whether the entanglement has occurred.

In addition, it may be determined whether the entanglement has occurred using a combination of the three factors (condensed water amount, temperature, and relative humidity). That is, although it is determined that the entanglement has occurred through one factor, it may be determined that the entanglement has not occurred through the comparison with another factor.

The control method may include changing the rotational direction of the drum to the reverse direction when it is determined that the entanglement has occurred (S350). Subsequent processing (S332 and S342) is the same as when the drum rotates in the forward direction, and thus detailed description thereof will be omitted.

Specific values may be set as the above-described entanglement humidity value (c), entanglement temperature variation value (d), and entanglement condensed water variation value (e), but may be compared with a variation rate per unit time that is the closest from the current time among variation rates per unit time of the temperature or relative humidity of the air discharged from the drum.

For example, when the unit time is designated as five minutes, the control method may include comparing a variation rate of each factor for the current five minutes with respect to time and a variation rate of each factor for immediately previous five minutes with respect to time. When the current variation rate with respect to time of each factor is greater than a value obtained by multiplying the variation rate with respect to time of each factor for the immediately previous five minutes by a coefficient k greater than 1, it may be determined that the entanglement has occurred.

Figure 11:
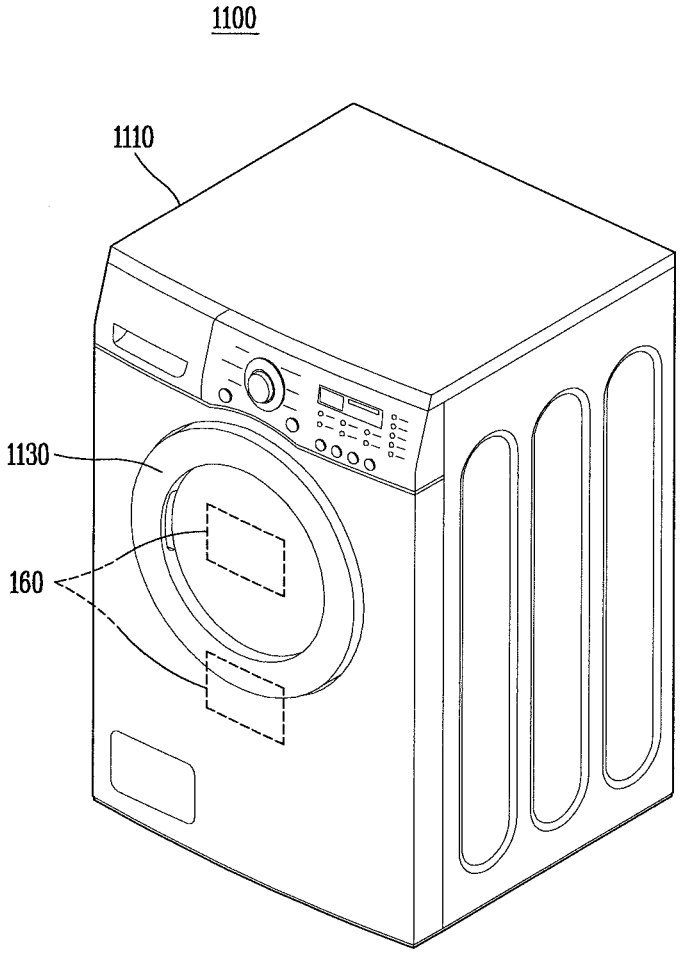
FIG. 11 is a schematic diagram showing an exterior of an example exhaust type clothes dryer.

FIG. 11 is shows an example of an exhaust type clothes dryer 1100.

Referring to FIG. 11, the dryer 1100 includes a main body 1110 forming an exterior, a drum disposed inside the main body 1110 and configured to accommodate a wet object, an inflow duct 430 (see FIG. 18) disposed on the rear side of the main body 1110 and configured to allow air heated by a heater to flow into the drum, a door 1130 installed in the main body 1110 and configured to open and close an opening of the drum, an exhaust part formed in the lower portion of the opening of the drum and configured to discharge the air from the drum, and a mounting part 160 disposed in at least one of the inflow duct and the exhaust part and configured to have a dehumidification module 1050 (see FIGS. 12A-12C), which may include a moisture absorber 1020 removably formed therein. The moisture absorber 1020 may be made of dehumidification material to absorb moisture in the air and configured to discharge and reuse the absorbed moisture.

Figure 12A:
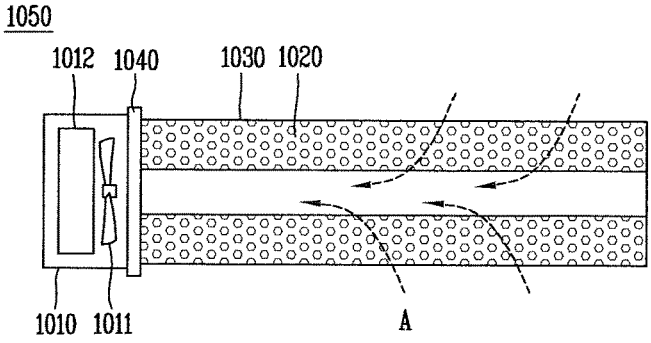
FIGS. 12A-12C are conceptual views showing elements of an example dehumidification module.
Figure 12B:
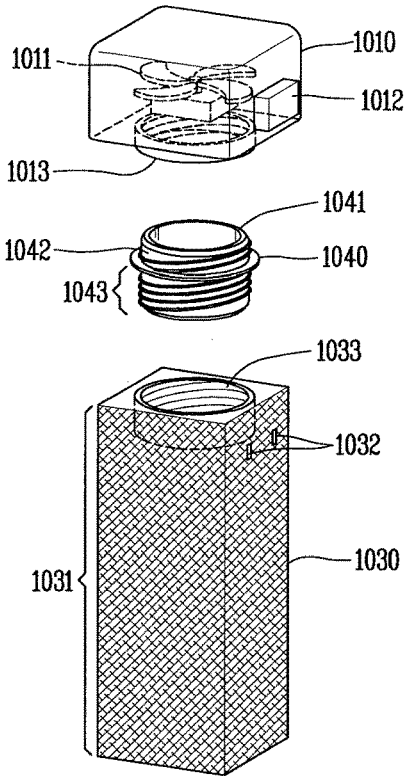
Figure 12C:
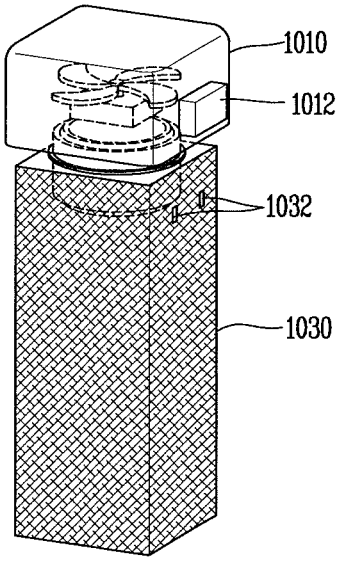

Referring also to FIGS. 12A-12C, the dehumidification module 1050 may include a fan part 1011 configured to blow air, the moisture absorber 1020, a main body part 1030 configured to have the moisture absorber, and a connector 1040 configured to connect the fan part 1011 and the main body part 1030.

When the mounting part 160 is positioned at a side (a lower side of FIG. 11) of a filter mounting part for removing foreign material from the air discharged from the drum, the position may lead to a bottle neck part in which air is gathered, and thus the dehumidification rate may be enhanced. When the mounting part 160 is positioned at a place (an upper portion of FIG. 11) in which the door may be observed, dehumidification visibility may be enhanced for the user.

In addition, when the mounting part is installed in the filter mounting part and the door, attachment and detachment may be more convenient for the user.

FIG. 12A shows a cross section of the dehumidification module 1050. FIG. 12B shows a view in which elements of the dehumidification module 1050 are separated, and FIG. 12C is shows a view in which the elements of the dehumidification module 1050 are combined.

Referring to FIGS. 12A-12C, the fan part 1010 may include a fan unit 1011 for blowing air in one direction. The fan unit 1011 may rotate to form forced flow. The direction of the flow is formed from the exterior of the main body part 1030 toward the fan part 1010, like direction A shown in FIG. 12A.

The moisture absorber 1020 may be disposed in an opposite direction of a blow direction of the fan unit 1011 and may be made of dehumidification material to absorb moisture in the air.

The main body part 1030 may have a space for including the moisture absorber 1020 formed therein and may have an outer surface in the form of a mesh such that the surface is aerated. That is, the outer surface of the main body part 1030 may be formed in a mesh structure such that the air may easily pass through the surface. In addition, the fan part 1010 and the connector 1040 may include a lattice structure such that the air may easily pass through the surface.

The connector 1040 may be inserted into the fan part 1010 and the main body part 1030 such that the fan part 1010 and the main body part 1030 may be combined with each other.

In some cases, when the dehumidification module 1050 performs dehumidification in a clothes cabinet, etc., the dehumidification module 1050 may operate in connection with the fan part 1010. In addition, when the dehumidification module 1050 that absorbs moisture is recycled in the dryer, the dehumidification module 1050 may be recycled in connection with or separately from the fan part 1010.

The recycling and reuse of the moisture absorber 1020 may be repeated several tens of times. Thus, since the performance of the moisture absorber 1020 is reduced, the moisture absorber 1020 may need to be replaced. The dehumidification module 1050 is designed to allow separation between the connector 1040 and the fan part 1010 to enable the moisture absorber 1020 to be replaced.

The moisture absorber 1020 may be made of material that is recyclable to discharge the absorbed moisture. Accordingly, the moisture absorber 1020 may discharge the absorbed moisture by hot air of the dryer.

The moisture absorber 1020 may have a generally rectangular shape. The moisture absorber 1020 may be foldable. In some cases, the moisture absorber 1020 may be folded and inserted into the main body part 1030.

The connector 1040 may be formed as a cylindrical member 42 having a hollow part 1041 through which air may pass. A screw thread 1043 may be formed on an outer surface of the connector 1040 such that the connector 1040 may be rotationally combined with or separated from the fan part 1010 and the moisture absorber 1020.

The fan part 1010 may further include a battery 1012 for supplying power to the fan unit 1011. A battery terminal 1032 connected with the battery and configured to supply power to the battery from the outside may be formed on in the main body part 1030.

The fan unit 1011 may be supplied with power by the battery and configured to operate with the power. In addition, the battery may be connected with a battery terminal disposed at the outside of the main body part 1030. Accordingly, when the dehumidification module 1050 is mounted on the dryer and recycled, the battery terminal and the dryer may be connected in order to charge the battery. However, unlike what's illustrated in FIGS. 12A-12C, the battery terminal may be disposed outside the fan unit 1010.

Conventional disposable dehumidifying agent performs dehumidification through natural convection and thus can require a significant amount of time. The dehumidification module 1050 may have a small fan unit installed therein and form forced convection (flow of air), thus allowing a quicker dehumidification effect compared with the conventional method.

Figure 13:
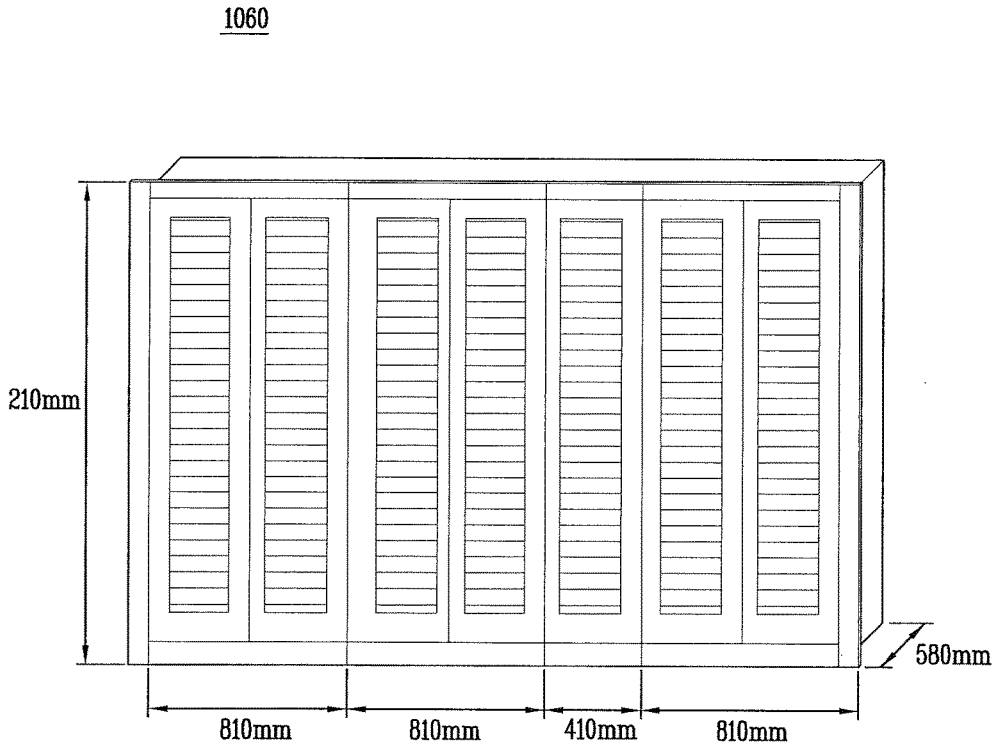
FIG. 13 is perspective view showing an example appearance of a general clothes cabinet.

FIG. 13 shows an appearance of a general clothes cabinet.

The dehumidification module may be produced in a size enough to be put in the general clothes cabinet 1060. The dehumidification module having this size may be produced to dehumidify about 50 to 60 cc of water during one dehumidification. When the dehumidification module is recycled using the dryer, the dehumidification module may be used to dehumidify a closet at a low cost.

$$V_{inside\ cabinet} = W \times H \times D = 0.81 \times 2.1 \times 0.58 = 0.99\ \mathrm{m}^3 \qquad \text{[Equation (1)]}$$

$$\rho_{air@30°\ C.,75\%} = \frac{1}{v} = 1.1276\ \mathrm{kgDA/m}^3$$

$$m_{air\ inside\ cabinet} = \rho_{air@30°\ C.,75\%} \times V_{inside\ cabinet} = 0.99 \times 1.1276\ \mathrm{kg/kgDA}$$

$$w'_{air@30°\ C.,75\%} = 0.020274\ \mathrm{kg/kgDA}$$

$$m_{vapor} = w'_{air@30°\ C.,75\%} \times m_{air\ inside\ cabinet} = 22.7\ \mathrm{g}$$

where, $V_{inside\ cabinet}$ = Volume in cabinet ($\mathrm{m}^3$)

Equation (1) shows a result obtained by calculating the amount of humidity inside the clothes cabinet 1060 that is about 300 cm in length and is generally used at home on the basis of average temperature and humidity during summer months. It can be seen that the amount of humidity, that is the mass of the vapor, is about 23 g.

Equation (1) shows the amount of dehumidification performed per hour through the dehumidification module having the fan unit forming a flow and the battery. Referring to this, the dehumidification module can absorb about 60 g of moisture every hour. As described above, since the humidity inside the clothes cabinet 1060 is about 23 g, the clothes cabinet 1060 may be theoretically dehumidified within about 20 to 30 minutes.

Figure 14:
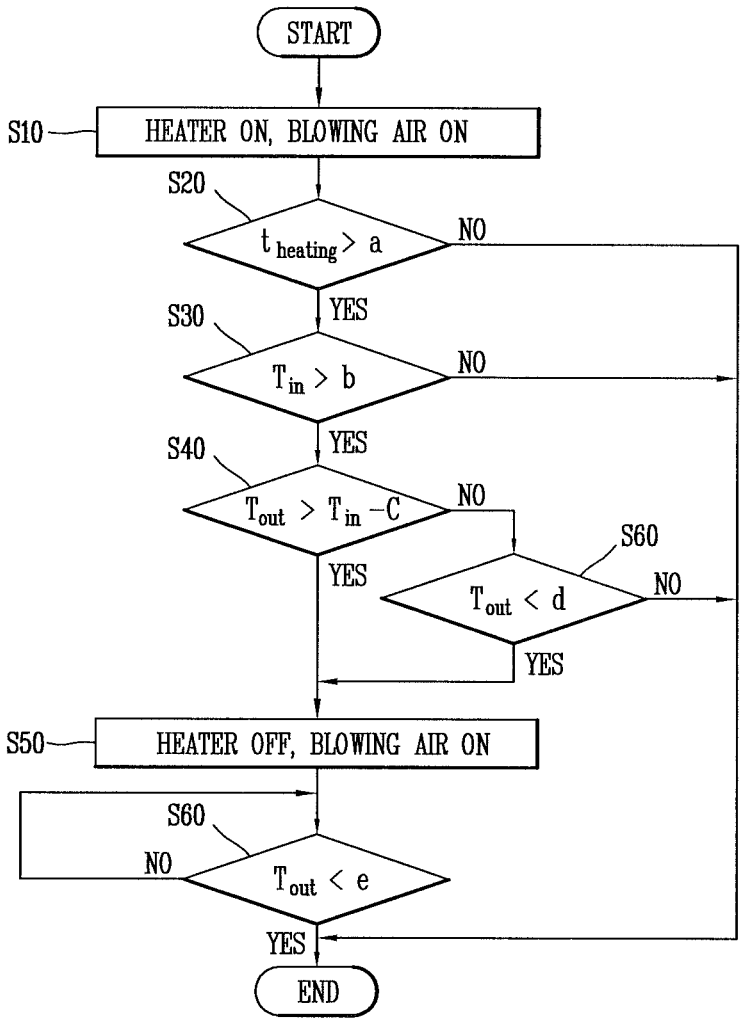
FIG. 14 is a flowchart illustrating an example control method of a dryer drying a dehumidification module.

FIG. 14 is a flowchart illustrating an example control method of a dryer drying a dehumidification module according to an embodiment of the present invention.

Referring to FIG. 14, the control method of recycling the dehumidification module of the dryer may include operating a heater for heating air to recycle the dehumidification module. In this case, the heated air may be blown. In consideration of the amount of dehumidification of the dehumidification module and an operating temperature and a heating capacity of a discharge type dryer, the recycling of the dehumidification module may be achieved within a quick time. However, considering time taken to heat the main body of the dryer, a certain time of operation may be needed. The operating of the heater for heating air considers time taken to operate a dehumidification module recycling program, operate the heater, and then sufficiently heat the air.

When the temperature of the heated air is equal to or higher than a predetermined recycling temperature (a) (S20), the temperatures of the air before and after passing though the dehumidification module may be measured. The control method may include additionally comparing the temperature (front end temperature Tin) of the air before passing through the dehumidification module with certain temperature (b) at which the dehumidification module may be actively recycled.

Subsequently, the control method may include comparing a difference between the measured temperatures of the air before and the after passing through the dehumidification module with a predetermined end temperature difference (S40). When the temperature (rear end temperature Tout) after passing through the dehumidification module is greater than the end temperature difference (c) subtracted from the front end temperature Tin, the control method may include determining that the recycling of the dehumidification module is almost completed and thus there is not actually a difference between the front end temperature and the rear end temperature of the dehumidification module and stopping the heater (S50). In this case, the heater is stopped, but the blowing fan unit may be operated to decrease the temperature and complete the recycling of the dehumidification module with the remaining heat in the air.

After the measuring of the temperatures of the air before and after passing through the dehumidification module, the control method may further include comparing the measured temperature Tout of the air after passing through the dehumidification module with predetermined unloading temperature (d) and stopping the heater (S41). When the temperature (the rear end temperature Tout) of the air after passing through the dehumidification module almost reaches a maximum temperature at which the dryer satisfies an unloading condition, it is determined that the recycling of the dehumidification module has been completed and thus the heater is stopped.

The control method may further include, after stopping the heater, comparing the temperature of the air having passed through the dehumidification module with predetermined end temperature to stop blowing the air (S60).

The control method may also further include measuring relative humidity of the air that has passed through the dehumidification module and comparing the measured relative humidity with predetermined completion relative humidity to stop the heater (not shown). Air having a high relative humidity is discharged when the dehumidification module is being recycled, and the relative humidity significantly decreases after the recycling is completed. Thus, the method of measuring the relative humidity and performing comparison can effectively confirm that the recycling of the dehumidification module that absorbs moisture has been completed.

In general, the recycling of the dehumidifying agent through silica gel may be performed at about 110 to 120° C., and an operating temperature of a discharge type dryer is greater than the above temperature. Accordingly, the dehumidifying agent (moisture absorber) can be recycled in a comparatively short time.

When the dehumidification module recycling program ends, the dryer may further include producing an alarm sound. Through this, the user may be easily made aware that the recycling of the dehumidification module ends.

Figure 15A:
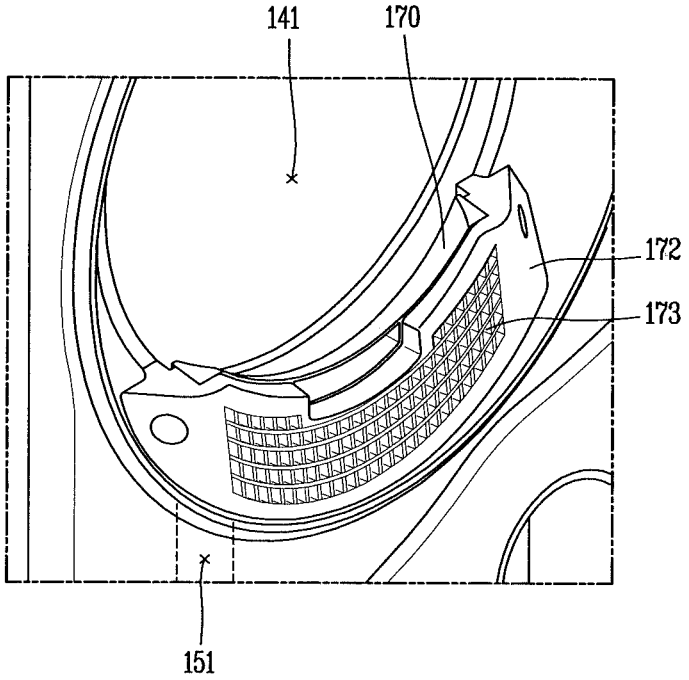
FIGS. 15A and 15B are close-up views illustrating an example insertion of a mounting part into a lint filter side.
Figure 15B:
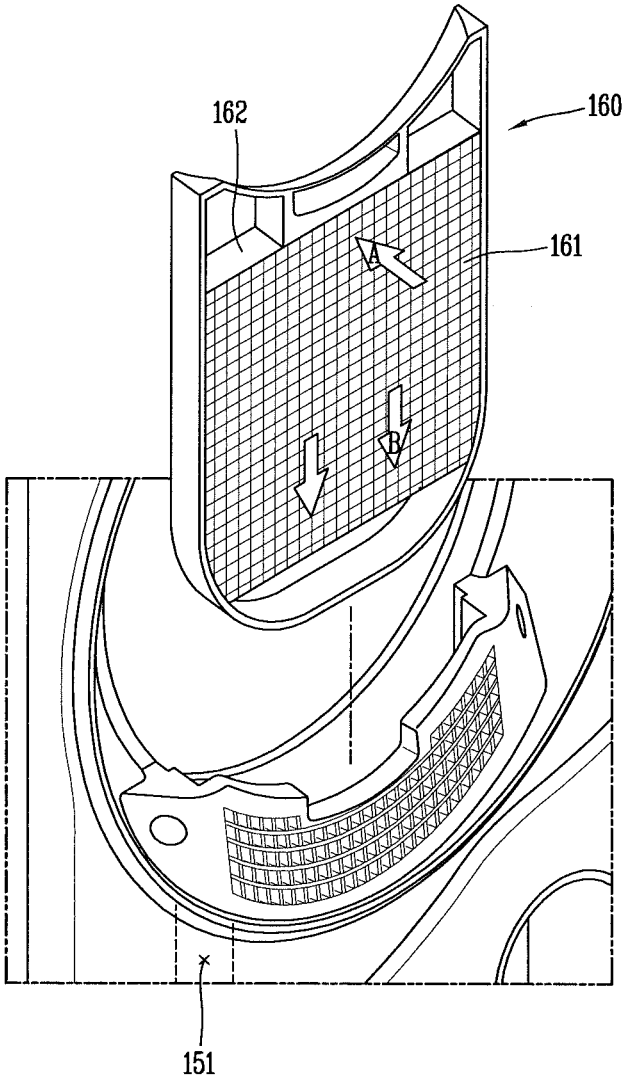

FIGS. 15A and 15B illustrate an example in which the mounting part 160 is inserted into a lint filter inflow part 170.

Referring to FIGS. 15A and 15B, an exhaust part 151 for discharging air from a drum may be formed at a lower portion of an opening of the drum and in close proximity to a window 141 formed in a door. In an upper portion of the exhaust part 151, a flow path plate 172 in which a plurality of flow paths 173 that gather air when the air is discharged from the drum may be formed along an outer circumference of the opening of the drum.

The lint filter inflow part 170, which can include a lint filter mounted thereon, may be formed in the flow path plate 172 such that foreign material included in the discharged air may be filtered out. The lint filter inflow part 170 may be formed such that the lint filter may be inserted or separated and thus may be passively cleaned. In this case, the mounting part 160 may be formed to be attachable to or detachable from the lint filter inflow part 170 from which the lint filter has been removed.

In some cases, the mounting part 160 may include a frame 161 and an attachable member 162.

The frame 161 is formed as an appearance of the mounting part 160 and formed to be insertable into the lint filter inflow part 170. Since the frame 161 is insertable into the lint filter inflow part 170, the frame 161 may be formed similarly to the appearance of the lint filter. A hook structure for allowing the frame 161 to be fixedly mounted on the lint filter inflow part 170 may be provided to the outer surface of the frame 161.

An attachable member 162 may be formed inside the frame 161, and the moisture absorber may be removably formed. As described above, the moisture absorber may be formed in the shape of a rectangle and may be formed to be inserted into and withdrawn from the main body part in a folded state. In this case, a recycling program of the moisture absorber may be executed by withdrawing the moisture absorber from the main body part, attaching withdrawing the moisture absorber to the attachable member 162, and inserting the frame 161 into the lint filter inflow part 170.

As illustrated in this example configuration shown in FIG. 15B, the air flow may move in a lateral direction (direction A), turn down (direction B), and exit to the outside. The air flow can efficiently recycle the dehumidification module or the moisture absorber.

Figure 16A:
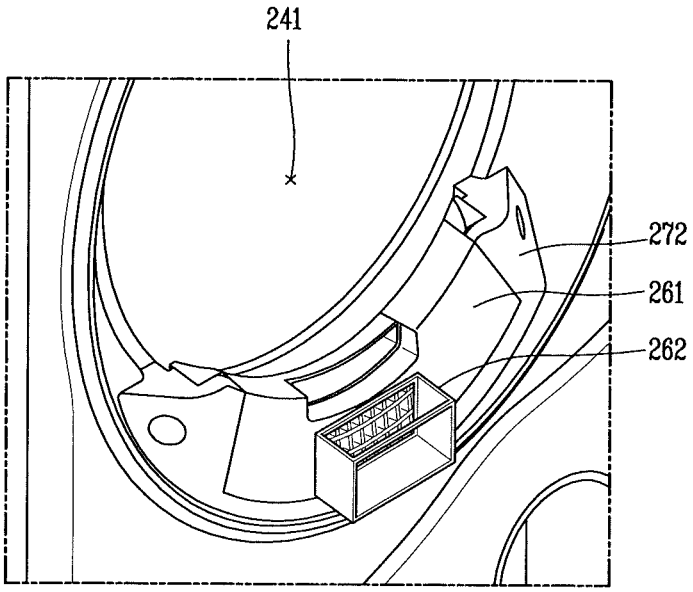
FIGS. 16A and 16B are close-up views illustrating an example installation of a mounting part inside a drum in a flow path plate.
Figure 16B:
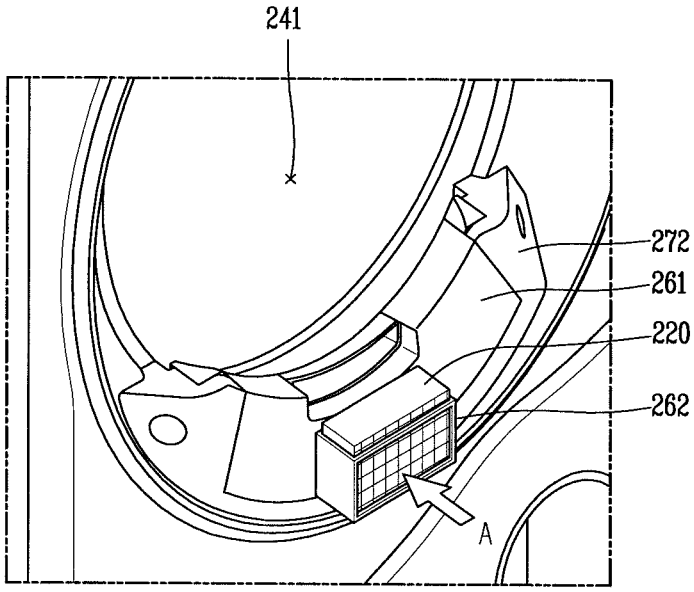

FIGS. 16A and 16B illustrate an example in which a mounting part is installed inside a drum in a flow path plate formed toward an exhaust part and configured to collect air.

Referring to FIGS. 16A and 16B, the mounting part may include a hanging part 261 and a holding member 272.

The hanging part 261 may be formed to be installable in one side of the lint filter inflow part formed adjacent to the exhaust part. The hanging part 261 may be formed to cover a plurality of flow paths formed in the flow path plate 172 such that the air flow discharged to the exhaust part may be not dispersed into the lint filter inflow part but may be condensed into the dehumidification module.

The holding member 272 may extend from the hanging part 261 to the inside of the drum. A moisture absorber 220 may be accommodated in the holding member 272. However, unlike FIGS. 16A and 16B, the dehumidification module may also be accommodated. The holding member 272 may be provided in a plural number, and the moisture absorber and the dehumidification module may be accommodated in the plurality of holding members 272.

Figure 17A:
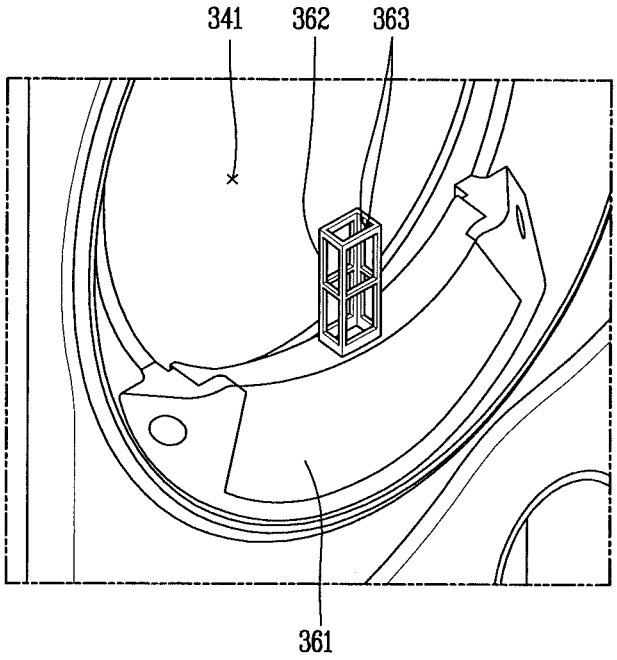
FIGS. 17A and 17B are close-up views illustrating an example installation of a mounting part toward a door in a flow path plate.
Figure 17B:
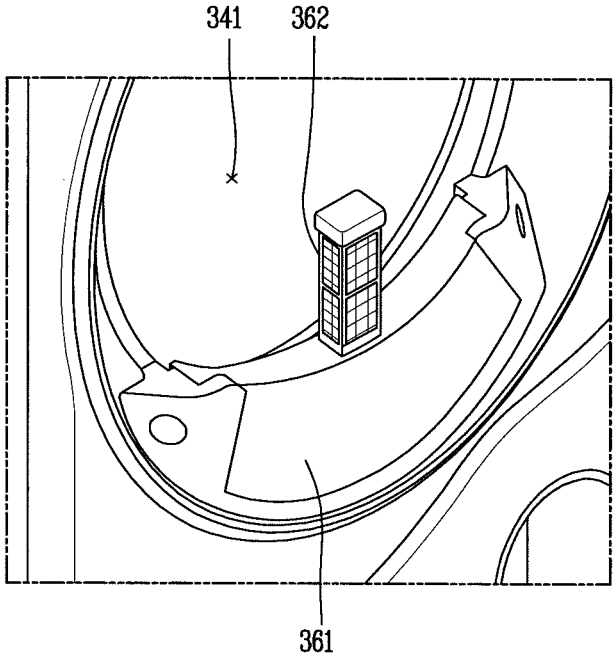

FIGS. 17A and 17B illustrate an example in which an amounting part is installed toward a door in a flow path plate.

Referring to FIGS. 17A and 17B, the mounting part may include a cover member 361 formed to cover the exhaust part and a holding member 362 formed to extend from the cover member 361.

The cover member 361 may be formed to cover the flow path plate such that the air inside the drum is not discharged through the flow path plate 172 (see FIG. 16A). The cover member 361 may cover the exhaust part while covering the flow path plate. A through hole for communicating the drum and the exhaust part may be provided to discharge the air inside the drum to the exhaust part. The through hole may be formed below a point at which the cover member 361 and the holding member 362 are in contact with each other. When the moisture absorber or the dehumidification module is held in the holding member 362, the through hole is used to condense the air flow to increase efficiency.

The holding member 362 may extend from the through hole to the upper portion and thus may be observed at the door. The dehumidification module may be mounted as shown in FIG. 17B. Unlike FIGS. 17A and 17B, however, the holding member 362 may be provided in a plural number and may be formed such that at least one of the moisture absorber and the dehumidification module can be held.

In this case, the dehumidification module may include a battery for supplying power to the fan part, and the main body part may include a battery terminal for supplying external power to the battery. When the dehumidification module is mounted, the mounting part may include a charging part 363 formed to supply power to the battery terminal.

Figure 18:
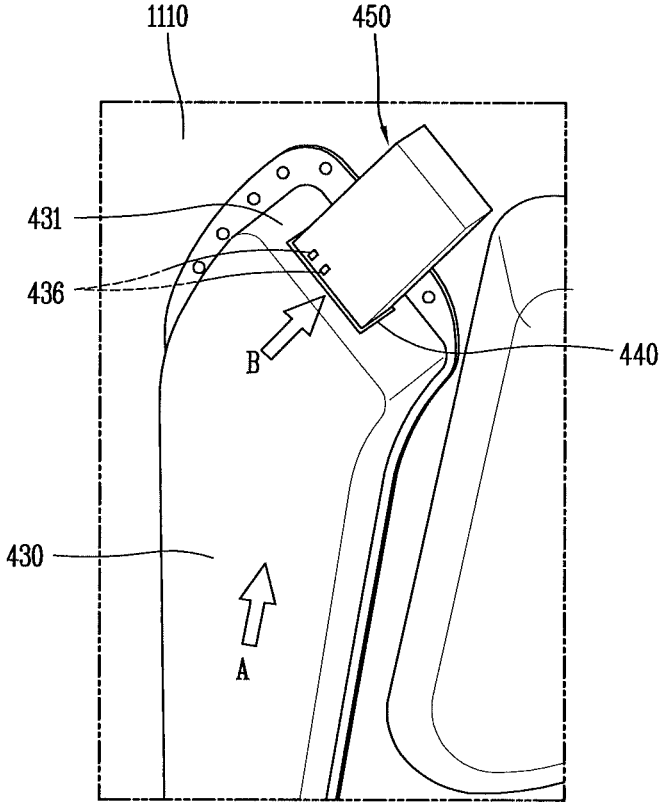
FIG. 18 is a partial close-up view showing an example mounting part that is disposed in an inflow duct.

FIG. 18 shows a mounting part that is disposed in an inflow duct 430.

In this implementation, the mounting part is formed in the inflow duct 430 exposed on the rear surface of the main body 1110 of the dryer. At least one of a dehumidification module 450 and its moisture absorber may be mounted on the mounting part. The dehumidification module 450 may be configured similarly as the dehumidification module 1050 shown in FIGS. 12A-12C.

Referring to FIG. 18, at least a portion of the inflow duct 430 may be formed to expose on the rear surface of the main body 1110.

The mounting part may be formed on one side of the exposing surface of the inflow duct 430. It can be seen, from FIG. 18, that the mounting part is formed in an upper surface 431 of the inflow duct 430. Unlike FIG. 18, however, the mounting part may be formed on another surface. However, the mounting part may be installed later than a heater disposed in the inflow duct 430. That is, after the air flows through the heater in the inflow duct 430 and heats up to hot air, it is preferred that the dehumidification module 450 or moisture absorber is dried by the hot air flowing through the mounting part. The mounting part may be provided in a plural number.

The mounting part may be formed as a structure for communicating with the inside of the inflow duct 430. Accordingly, the mounting part may be formed such that the dehumidification module 450 or the moisture absorber may be mounted by pushing the dehumidification module 450 or the moisture absorber into the inflow duct 430.

With continuing reference to FIG. 18, the dehumidification module 450 can be inserted into the mounting part. Referring back to FIG. 12A, the connector 1040 of the dehumidification module 1050 was shown as protruding radially outward from the main body part and the fan part. Accordingly, a connector 440 of the dehumidification module 450 may be rested on the upper surface 431 of the inflow duct 430, thus preventing the dehumidification module 450 from being excessively pulled into the inflow duct 430.

When the dehumidification module 450 is mounted on the mounting part, a charging terminal for charging the battery terminal 436 of the dehumidification module 450 may be formed in the mounting part.

In addition, since the mounting part is installed after the heater in the inflow duct 430, the function may be used at the same time as a clothes drying function.

The example dryer shown in FIGS. 10 to 18 includes a casing configured to form an exterior, a drum disposed inside the casing and configured to accommodate a wet object, an inflow duct disposed on the rear side of the casing and configured to allow air heated by a heater to flow into the drum, a door installed in the casing and configured to open and close an opening of the drum, an exhaust part formed in the lower portion of the opening of the drum and configured to discharge the air from the drum, and a mounting unit disposed in at least one of the inflow duct and the exhaust part and configured to have a moisture absorber or a dehumidification module removably formed therein. The moisture absorber is formed of dehumidification material to absorb moisture in the air and configured to discharge and reuse the absorbed moisture. The dehumidification module includes a fan unit configured to blow air, the moisture absorber, a main body part configured to have the moisture absorber, and a connector configured to connect the fan part and the main body part.

In some implementations, the exhaust part may include a lint filter inflow part equipped with a lint filter formed to filter out foreign material included in the air discharged from the drum, and the mounting part may include a frame formed as an exterior and formed to be insertable into the lint filter inflow part and an attachable member formed inside the frame and formed such that the moisture absorber is attachable to the attachable member.

In other implementations, the mounting part may include a hanging part formed to be installable in one side of the lint filter inflow part formed adjacent to the exhaust part and a holding member extending from the hanging part toward the inside of the drum and configured to accommodate at least one of the moisture absorber and the dehumidification module.

In still other implementations, the mounting part may include a cover member mounted to cover the exhaust part and having a through hole for communicating between the drum and the exhaust part and a holding part extending from the through hold to the upper portion such that the holding part is observable from the door and holding at least one of the moisture absorber and the dehumidification module.

In still other implementations, at least a portion of the inflow duct is formed to be exposed on the rear surface of the casing, and the mounting part is formed on one side of the exposing surface of the inflow duct and formed such that at least one of the moisture absorber and the dehumidification module is at least partially pulled into and mounted on the inflow duct.

In still other implementations, the dehumidification module may include a battery that supplies power to the fan part, the main body part may include a battery terminal for supplying external power to the battery, and the mounting part may include a charging part that supplies power to the battery terminal when the dehumidification module is mounted.

A method of controlling a dryer in order to achieve the above-described objective of the present disclosure may include operating a heater for heating air to recycle the dehumidification module, measuring temperature of the heated air, comparing the measure temperature with predetermined recycling temperature to measure temperature of the air before and after passing through the dehumidification module, and comparing a difference between the measured temperatures of the air before and after passing through the dehumidification module with a predetermined end temperature difference to stop the heater.

In some implementations, the method may further include, after the measuring of the temperatures of the air before and after passing through the dehumidification module, comparing the measured temperature of the air after passing through the dehumidification module with predetermined unloading temperature to stop the heater.

In other implementations, the method may further include, after the stopping of the heater, comparing the temperature of the air after passing through the dehumidification module with predetermined end temperature to stop blowing the air.

In still other implementations, the method may further include measuring relative humidity of the air that has passed through the dehumidification module and comparing the measured relative humidity with predetermined completion relative humidity to stop the heater.

However, the present disclosure is not limited to the configurations and methods of the above-described implementations, and various modifications to the implementations may be made by selectively combining all or some of the implementations.

What is claimed is:

1. A dryer comprising a drum positioned therein, a motor configured to rotate the drum, a condenser configured to condense moisture in air that is discharged from the drum and that passes through the condenser, a condensed water sensor configured to detect a weight of condensed water that is discharged from the drum per unit time, a sensor configured to detect at least one of a temperature or a relative humidity of air discharged from the drum, and a controller configured to control the dryer, the controller being configured to:

rotate the drum in a first direction;

detect a temperature of air discharged from the drum rotating in the first direction;

detect a relative humidity of air discharged from the drum rotating in the first direction;

detect a weight of condensed water that is discharged from the drum;

sense an occurrence of entanglement of laundry inside the drum by comparing (i) a temperature variation rate of the detected temperature per unit time to a first reference value, (ii) a humidity variation rate of the detected relative humidity per unit time to a second reference value, and (iii) a weight variation rate of the detected weight of condensed water per unit time with a third reference value;

based on sensing that the entanglement has occurred, rotate the drum in a second direction that is opposite the first direction.

2. The dryer of claim 1, wherein the controller is further configured to, based on the relative humidity of air being greater than a reference value, sense the occurrence of the entanglement inside the drum.

3. The dryer of claim 1, wherein the controller is further configured to:

maintain the rotational direction of the drum in the first direction during a first preset time before the sensing of the occurrence of the entanglement inside the drum; and maintain the rotational direction of the drum in the second direction during a second preset time after the sensing of the occurrence of the entanglement inside the drum, wherein the second preset time is longer than the first preset time.

4. The dry of claim 3, wherein the controller is further configured to, based on the relative humidity of air being greater than a reference value after rotating the drum in the first direction for the first preset time:

determine whether the temperature variation rate is greater than the first reference value;

determine whether the humidity variation rate is greater than the second reference value; and determine whether the weight variation rate is greater than the third reference value.

5. The dryer of claim 3, wherein the controller is further configured to not sense an occurrence of entanglement of laundry for the second preset time.

6. The dryer of claim 5, wherein the controller is further configured to, after rotating the drum in the second direction for the second preset time without sensing the occurrence of entanglement of laundry, detect a second relative humidity of air discharged from the drum rotating in the second direction.

7. The dry of claim 6, wherein the controller is further configured to, based on the second relative humidity of air being greater than a reference value:

determine whether the temperature variation rate is greater than the first reference value;

determine whether the humidity variation rate is greater than the second reference value; and determine whether the weight variation rate is greater than the third reference value.

8. The dryer of claim 1, wherein the controller is further configured to maintain the second direction of rotation of the drum through a fluctuation of the temperature or the relative humidity inside of the drum.

* * * * *